United States Patent [19]

Rovere

[11] 3,977,742

[45] Aug. 31, 1976

[54] ASSEMBLABLE STRUCTURE FOR SHELVES AND THE LIKE

[76] Inventor: Giuseppe Rovere, via Cornello Rovera 63, Gavirate (Varese), Italy

[22] Filed: May 5, 1975

[21] Appl. No.: 574,521

[30] Foreign Application Priority Data

Sept. 6, 1974 Italy ..... 5172/74

[52] U.S. Cl. ..... 312/111; 312/140.3; 312/263

[51] Int. Cl.[2] ..... A47B 47/00; F16B 12/00

[58] Field of Search ..... 312/109, 111, 140.3, 312/140.4, 263, 257 R, 257 SK

[56] References Cited

UNITED STATES PATENTS

| | | | |
|---|---|---|---|
| 3,656,786 | 4/1972 | Larsen | 312/140.3 |
| 3,822,924 | 7/1974 | Lust | 312/263 |
| 3,874,753 | 4/1975 | Naito et al. | 312/263 |

FOREIGN PATENTS OR APPLICATIONS

| | | | |
|---|---|---|---|
| 196,935 | 4/1938 | Switzerland | 312/263 |

*Primary Examiner*—Casmir A. Nunberg

[57] ABSTRACT

An assemblable multi-component structure for libraries and the like which comprises a plurality of panels connected to one another by connecting ribs. Protrusions in said ribs fit forcedly into corresponding depressions in said panels. Variations in the cross-sectional configuration of the connecting ribs permit the simultaneous connection of 2, 3 or 4 panels adjacently to one another.

9 Claims, 9 Drawing Figures

ASSEMBLABLE STRUCTURE FOR SHELVES AND THE LIKE

The present invention relates to an assemblable and disassemblable structure particularly suitable to construct shelves, book-cases or, generally, articles of furniture having a plurality of compartments or tiers.

The main object of the invention is to provide a structure consisting of a plurality of simple elements which allows the easy and rapid assembly of these elements into a complex structure. Obviously, for reasons of economy, these individual elements are preferably made of plastic material.

Briefly stated, the multi-component structure of the invention substantially comprises a plurality of panels suitable to form either the horizontal or the vertical surfaces of the structure, each panel having a plurality of seats or depressions provided on at least two sides (opposed to each other) of the panel. The structure mentioned hereabove comprises also a plurality of connecting listels or ribs, each of said connectors having a plurality of protrusions or wing-like portions shaped so as to engage forcedly the seats or depressions of the panel and, thusly, to connect at least two adjacent panels to each other; these connectors are furthermore shaped so as to connect any two panels either at right angle to each other or on the same plane.

Further details of the invention will become apparent from the following description and from the accompanying drawings, which are merely illustrative of the invention, in which drawings.

Figure 1:
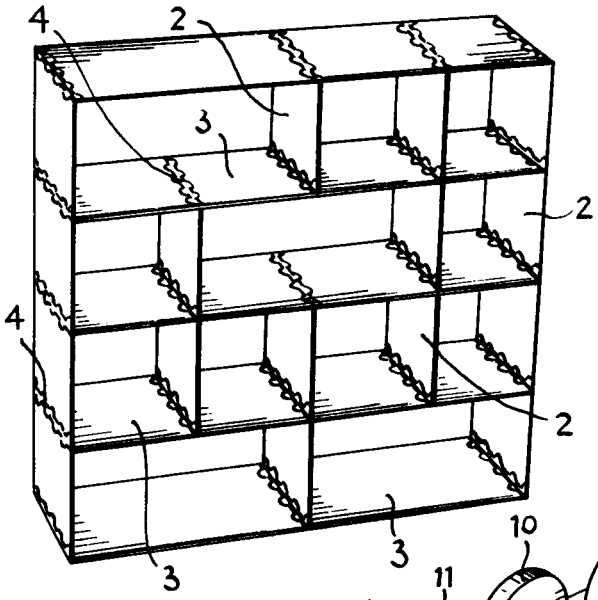
FIG. 1 is a schematic perspective view of an assembled structure, typically a wall library unit.
Figure 3:
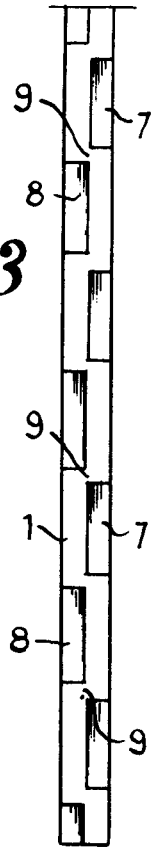
FIG. 3 is an edge view of the panel of FIG. 2.

Referring now to the drawings, the structure of the invention comprises a plurality of panels 1 forming either the vertical walls 2 or the horizontal walls 3 of the structure, and a plurality of connecting ribs 4 to connect to one another at least two contiguous panels, either normally or in the same plane.

Each of the panels 1 has predetermined dimensions and is advantageously suitably stamped from plastic material, although not necessarily so. Each panel has at least on two edges thereof, 5 and 6, pluralities of seats or depressions 7 and 8. These depressions are on edges always parallel and opposed to each other and are preferably, but not necessarily, semi-circular and with a depth equal to about one-half the thickness of the panel.

Figure 2:
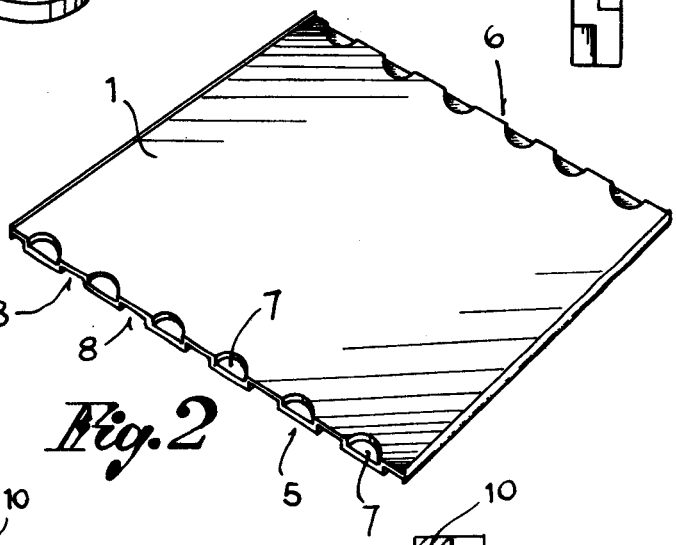
FIG. 2 is a perspective view of one of the panels of FIG. 1.

A first plurality of depressions is provided along one edge of the panel and on one surface thereof, while the depressions of the other plurality are provided along the opposite edge and on the opposite surface of the same panel (see FIG. 2). Furthermore, the depressions on one edge are off-set with respect to the depressions on the opposite edge, so that between each two depressions 7 and 8 there is a filled or undepressed area 9. In other words, one may say that these depressions are positioned in a zig-zag fashion.

Figure 4:
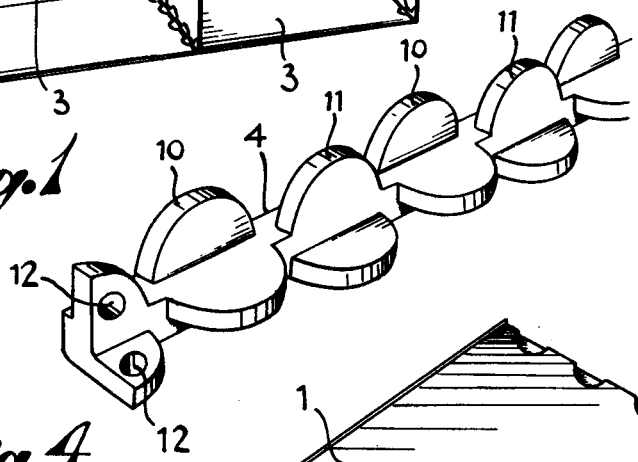
FIG. 4 is a perspective view of a connecting rib of FIG. 1, suitable for connecting two panels normal to each other.

The connecting rib 4, in turn, has a body section 4' which is provided on at least two adjacent sides thereof — see FIG. 4 — with two rows of protrusions or wings 10, 11. These protrusions have shape and dimension corresponding to those of the depressions 7 and 8 of the panel 1. The two rows of protrusions 10, 11 on each side of element 4 are parallel to each other and are positioned so that the protrusions of one row are off-set with respect to those of the other row, in the same manner as the two rows of depressions 7, 8 on the opposite edges 5, 6 are off-set with respect to each other.

Furthermore, the protrusions or wings located at one extremity of the connecting rib have, preferably, an aperture 12 therethrough to retain in fixed position the rear panel of the assembled structure.

Figure 8:
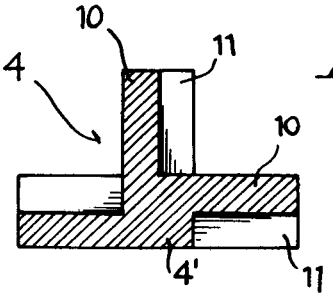
FIGS. 8 and 9 are sectional views of other combinations of connecting ribs for connecting pluralities of panels.
Figure 6:
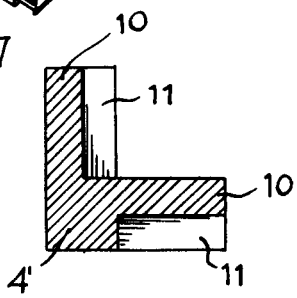
FIG. 6 is a cross-sectional view of the connecting rib of FIG. 4.
Figure 5:
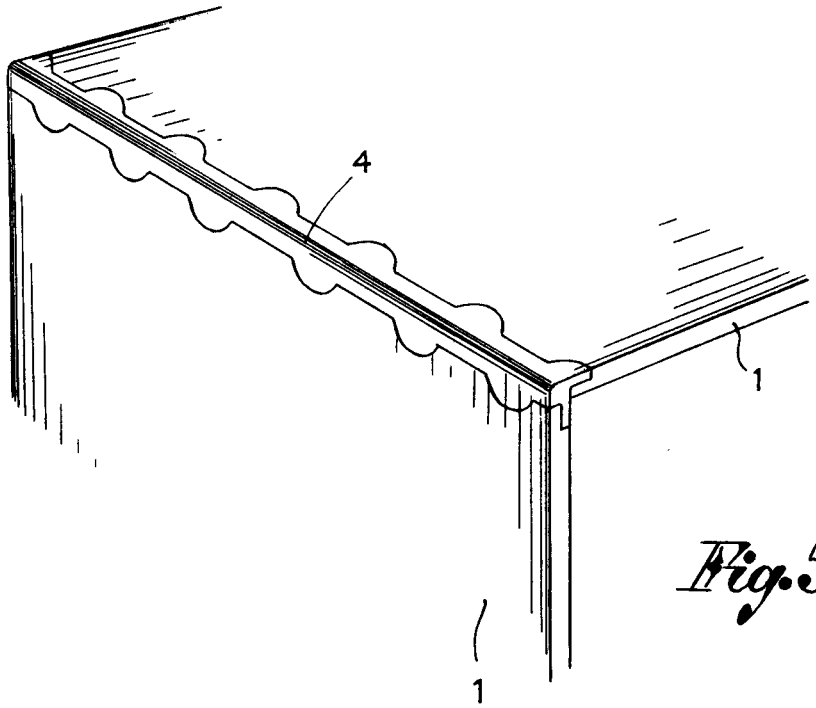
FIG. 5 shows how two panels are connected normally to each other.
Figure 7:
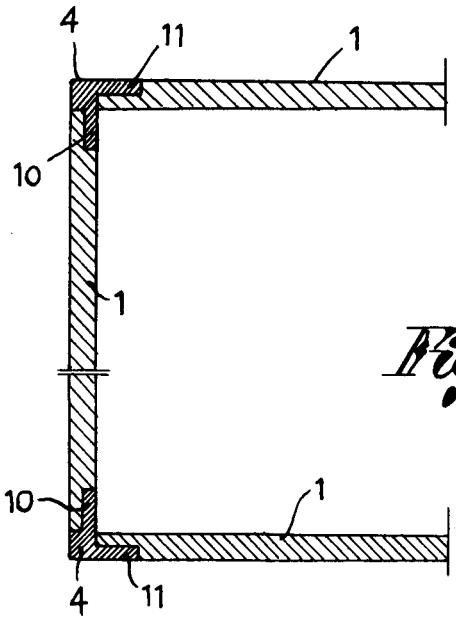
FIG. 7 is a sectional view of a plurality of panels connected to one another.
Figure 9:
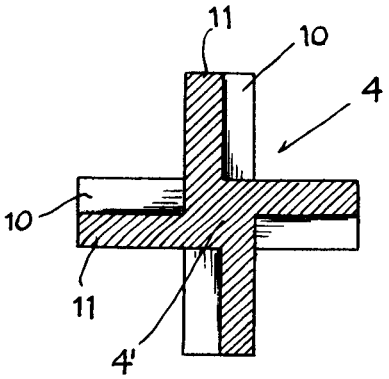

In FIGS. 4 and 6 of the accompanying drawings, an L-shaped connecting rib is seen, suitable for connecting to each other a pair of panels positioned perpendicularly to each other. However, the connecting rib may be substantially T-shaped — see FIG. 8 — to obtain the simultaneous connection of three adjacent panels. Also possible is a cross-sectional arrangement as shown in FIG. 9, to obtain the concurrent connection of four panels to one another.

In any event, in order to obtain and assemble a composite structure, such as a book-shelf as typically represented in FIG. 1, the panels 1 are combined with one another so as to form the vertical and the horizontal walls of the structure and are connected to one another by means of the ribs 4. The connection is effected by forcedly seating the protrusions 10, 11 of the ribs 4 into the respective depressions 7, 8 of the panels so as to fixedly assemble the latter to one another. The size of the protrusions and that of the respective depressions is such, obviously, that a forced insertion of the former into the latter results. However, auxiliary retaining means are not necessary with the structure of the present invention.

It is, finally, to be observed that each element of the structure is readily disassembled by merely sliding one member from the other without altering the integral configuration thereof. This will obviously allow changes and variations in the structural appearance of the article constructed.

What is claimed is:

1. Assemblable, multi-component structure for libraries and the like, which comprises:

a plurality of panels having first and second surfaces and edges therebetween, said surfaces being opposed to each other and said edges being opposed in pairs;

a first plurality of depression isolated from each other and spaced apart along at least one edge of said first surface;

a second plurality of depressions isolated from each other and spaced apart along the edge of said second surface opposite said one edge;

a plurality of elongated connecting ribs for connecting said panels to one another;

a first plurality of protrusions in said rib, sized so as to forcedly mate with a corresponding plurality of depressions in one panel, said first plurality of protrusions being isolated from each other and spaced apart along the length of said rib; and a second plurality of protrusions in said rib, sized so as to forcedly mate with a corresponding plurality of depressions in another panel contiguous to said one panel, said second plurality of protrusions being isolated from each other and spaced along the length of said rib.

2. The structure of claim 1, wherein said depressions are semi-circular and have a depth equal to about one-half the thickness of said panel.

3. The structure of claim 1, wherein said depressions located along one edge of said panel are partly positioned on one surface of the panel and partly on the other and opposite surface thereof, the depressions on said one surfaces being off-set with respect to those of said other surface so as obtain a separating, full and undepressed area therebetween.

4. The structure of claim 1, wherein said protrusions in said connecting rib are aligned in two parallel and off-set rows, the protrusions in one row being off-set with respect to those of the other row.

5. The structure of claim 1, wherein said connecting rib is cross-sectionally L-shaped so as to connect two panels perpendicularly to each other.

6. The structure of claim 1, wherein said connecting rib is T-shaped cross-sectionally so as to connect three panels to one another.

7. The structure of claim 1, wherein said connecting rib is cross-sectionally cross-like so as to connected four panels to one another.

8. The structure of claim 4, wherein the protrusions located at the extremities of each row have an aperture therethrough for fixedly retaining a rear panel of said structure.

9. The structure of claim 1, wherein the protrusions of said first plurality are off-set with respect to those of said second plurality.

* * * * *